United States Patent [19]

Gilb

[11] 4,106,257

[45] Aug. 15, 1978

[54] COMPOSITE TRUSS BEARING CLIP

[75] Inventor: Tyrell T. Gilb, Berkeley, Calif.

[73] Assignee: Simpson Manufacturing Co., Inc., San Leandro, Calif.

[21] Appl. No.: 809,529

[22] Filed: Jun. 24, 1977

[51] Int. Cl.[2] ..... E04C 3/02

[52] U.S. Cl. ..... 52/693; 52/714

[58] Field of Search ..... 52/712, 714, 697, 693, 52/694, 643

[56] References Cited

U.S. PATENT DOCUMENTS

| | | | |
|---|---|---|---|
| 3,229,440 | 1/1966 | Troutner | 52/712 X |
| 3,889,441 | 6/1975 | Fortine | 52/714 X |
| 3,946,532 | 3/1976 | Gilb | 52/693 |
| 4,047,352 | 9/1977 | Sweet | 52/712 |

*Primary Examiner*—Price C. Faw, Jr.
*Assistant Examiner*—Carl D. Friedman
*Attorney, Agent, or Firm*—James R. Cypher

[57] ABSTRACT

A clip for attaching composite structural trusses to lateral bracing members consisting briefly of an elongated metal member formed with a pin opening at one end for attachment to the metal truss connecting pin and a flat surface adapted for abutment with the edge face of the wood truss chord, and the other end of the clip is formed with fastener openings for receiving fasteners such as nails, screws or bolts therethrough for attachment to the wood brace member. The surface adjacent said fastener openings is flat for abutment with the side face of the wood brace.

5 Claims, 8 Drawing Figures

COMPOSITE TRUSS BEARING CLIP

BACKGROUND OF THE INVENTION

This invention is for use with composite trusses having wood chords and metal webbing as shown in Troutner, U.S. Pat. No. 3,137,899, June 23, 1964, Gilb, U.S. Pat. No. 3,857,218, Dec. 31, 1974 and Gilb's, Truss Structure with Clevis Assembly Joints, Ser. No. 758,061, filed Jan. 10, 1977 or the like.

In order for composite trusses to withstand the loads for which they are designed, it is essential that all elements of the truss remain in their original alignment. Any significant deviation in the alignment between the webs and chords is particularly critical because of the high moment forces which tend to overtune the chords. Rotation of the bottom chords will increase the moment forces and may result in premature failure of the truss and the structure carried by the truss. At each point, one web is in compression while the other is in tension. These forces are represented by arrows 2 and 3 which are opposite in direction. Since, as a practical matter, the webs are not attached to the truss pin at the exact same point, the arrows are separated by a moment arm 4. The moment of the two forces acting in opposite directions tend to cause the chord, in the instant case, to rotate in a clockwise direction as shown by arrow 6.

Prior to the present invention, truss designers did not recognize the problem of overturn and attempted to satisfy building code officials by providing single metal straps to connect the truss lower chord to the lateral bridging. As shown in FIG. 4, the prior art system (Trus Joist of Boise, Idaho) used a single metal strap 7 with one end 8 formed with an opening to receive pin 9 therethrough and the other end 11 was formed with fastener openings 12 for connection to the lateral bracing member 13. The metal strap was positioned between the metal webs 14 and 15 and thus was incapable of resisting the inherent overturning moments created by the compressions force 16 acting on web 15 and the tension force 17 acting on web 14. Thus the strap did not resist the clockwise turning force indicated by curved arrow 18 on lower chord member 19.

Sweets (U.S. patent application number unknown) appears to have recognized the problem of overturning moment forces and encircled the entire bottom and both sides of the wood chord; nailed the strap to the wood chord and then attached the free ends to the lateral bracing member. The Sweets strap uses far too much metal and more importantly, there is no attachment directly to the metal pin where the overturning force is occurring. With the Sweets strap, the overturning forces imposed by the webs act upon the pin and the forces are then transferred through the wood chord to the encircling Sweets strap. Further, the nails driven into the bottom wood chord in the Sweets method tend to split the wood chord and weaken it.

SUMMARY OF THE INVENTION

The gist of the present invention is the use of a pair of light metal clips, each connected to opposite ends of the metal truss connector pin and to the lateral brace. By connecting the clips to the outboard ends of the metal pin, the moment arm between the points of connection of the clips is much greater than the momemt arm between the metal webs where the overturning moment originates and hence a much lighter clip may be used.

By connecting the clips directly to the metal pin, the force moments are never carried into the wood chord which has little resistance to such forces. For example, in the Troutner truss U.S. Pat. No. 3,137,899, supra, the moment forces as shown in FIG. 4 exert a downward force on one side of the pin 9 and an upward force on the other side of the pin 9 which results in a tendency of the pin to cause the wood chord to split.

The clip of the present invention is less expensive to manufacture than some of the prior art straps, less metal is used, no additional fasteners are used to attach the clip to the wood truss chord which cause weakening of the chord.

DESCRIPTION OF THE PREFERRED EMBODIMENTS

Figure 1:
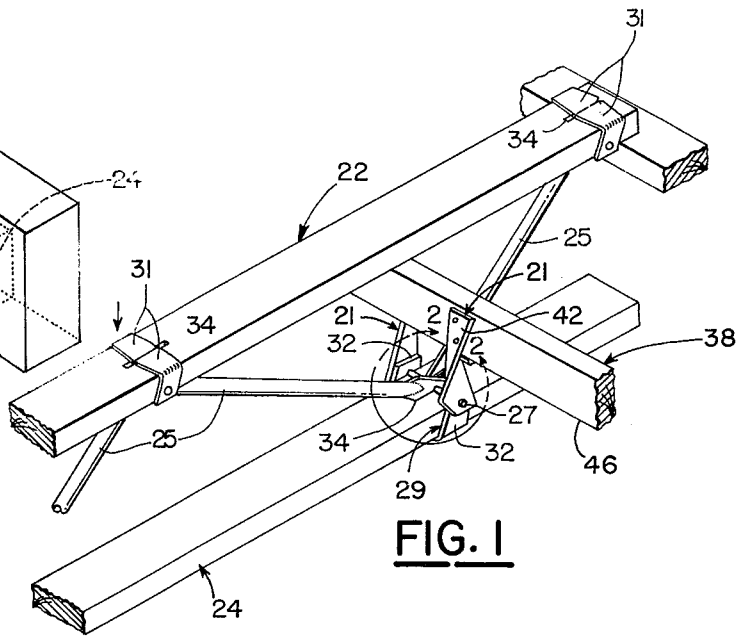
FIG. 1 is a perspective view of a portion of a truss with the bridging clip of the present invention connected to a lateral brace.
Figure 2:
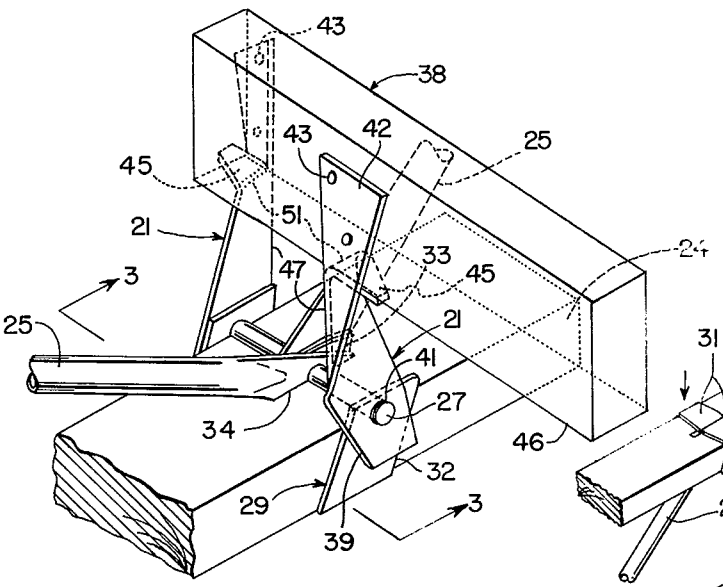
FIG. 2 is an enlarged view of a portion of the truss taken generally along line 2—2.
Figure 3:
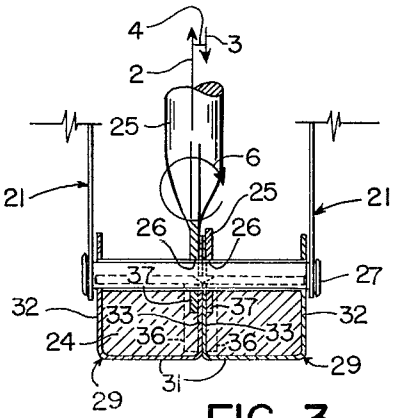
FIG. 3 is a cross section taken along line 3—3 of FIG. 2.
Figure 4:
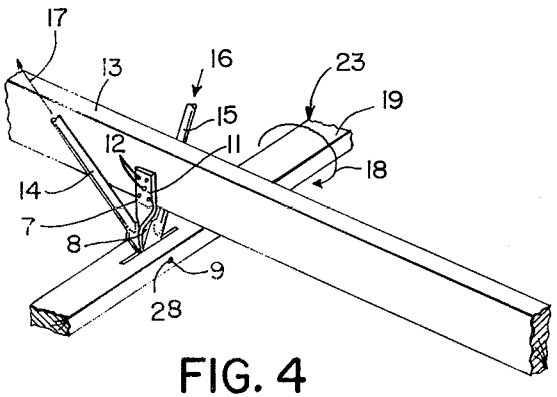
FIG. 4 PRIOR ART
FIG. 4 is a perspective view of a portion of a truss showing a Prior Art strap and brace.

The present invention consists of a bridging clip 21 for connecting composite trusses 22 and 23 to wood lateral brace 24 and 13. The truss as shown in FIGS. 1–3 includes a wood bottom chord 24 metal webs 25 formed with a pin opening 26 therethrough and metal pins 27 connected to the chords. The metal pins may be connected to the wood chord merely by inserting them into a bore hole 28 as shown in FIG. 4 or as shown in Gilb U.S. application, Ser. No. 758,061, filed Jan. 10, 1977 or preferably the pins are connected to the chords as shown in FIGS. 1, 2 and 3 by grip groove connectors 29 which are fully described in Gilb, U.S. Pat. No. 3,857,218 supra. Each grip groove connector consists of a seat 31 with an upstanding leg 32 which is formed with an opening for receiving the end of the pin 27 and an arm 33 which extends through a center slot 34 in the chord for receiving the midportion of the pin. Flanges 36 and 37 on each arm edge grip the midportion of the chord.

As shown in the drawings, the pin is sized to extend beyond the edges of the chord for connection of the clips.

The lateral brace 38 may be a 2 × 4, 2 × 6 or 2 × 8 depending on the truss span or design loads. The brace is located between the intersection of the webs as shown in the drawings.

The clips are used in pairs with one clip attached to each end of the metal pin as shown in FIGS. 1, 2 and 3. Each clip has a first end 39 formed with a pin opening 41 which is sized for a force fit upon the end of the pin, or the pin may have a threaded end for receipt of a threaded nut. The second end 42 of the clip is formed with a plurality of openings 43 for receiving fasteners therethrough such as nails, screws or bolts. The fastener openings are spaced at an appropriate pattern so that the fasteners may be attached to the wood brace.

The first end is preferably thin and flat so that the face of the member surrounding opening 41 of each clip may engage the edge of the truss chord. The second end 42 preferably is formed with a flat surface surrounding nail openings 43 for engaging the side of the wood brace 38.

Preferably, the clip is formed with a seat 45 for engaging the lower edge 46 of the wood brace. The seat accomplishes several functions. First, the seat enables the brace to be easily and quickly installed. Further, in the sheet metal form of the invention, the seat in the form of a bend tab provides rigidity to the clip.

Figure 5:
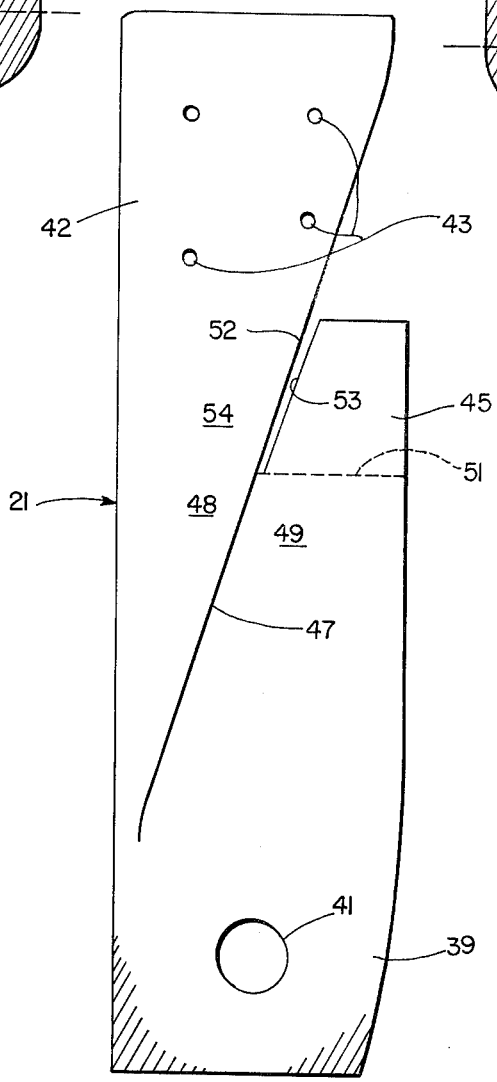
FIG. 5 is a plan view of the clip of the present invention prior to bending.

Referring to FIGS. 1–3 and 5, the sheet metal clip is formed from a generally rectangular metal strip. The sheet metal is formed with a diagonal bend line 47 and bent therealong providing right angularly related surfaces 48 and 49. A transverse bend line 51 is formed in the metal and bent therealong providing the seat means. Preferably the seat is formed by making a slit 52 parallel to the diagonal bend line which intersects the transverse bend line. As shown in FIG. 5, only a small portion of the rectangular clip is wasted. When the clip is formed, edge 53 of the seat is in touching contact with face portion 54 of the clip thereby giving the entire clip rigidity.

Figure 6:
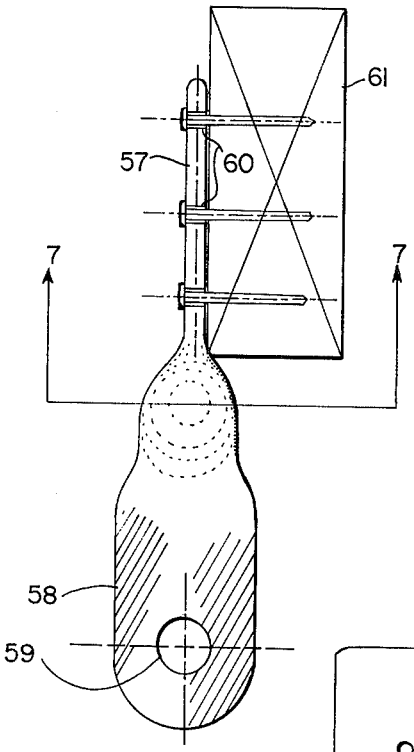
FIG. 6 is a side elevation view of an alternate form of clip.
Figure 7:
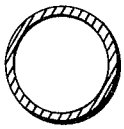
FIG. 7 is a cross section of the clip taken at line 7—7 of FIG. 6.

Another form of the invention is illustrated in FIG. 6. The clip may be constructed from a short length of pipe and flattened at ends 57 and 58 but at right angles to one another. An opening 59 is formed in one end for attachment to the outside end of the metal pin and the other end is formed with openings 60 for insertion of fasteners, such as nails, therethrough for attachment to the wood brace 61.

Figure 8:
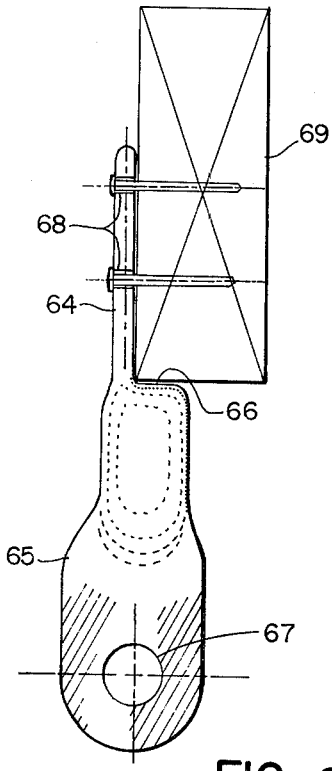
FIG. 8 is a side elevation view of another alternate form of clip.

Still another form of the invention is illustrated in FIG. 8. The clip may be constructed from a short length of pipe flattened at ends 64 and 65 at right angles to one another. A seat 66 is formed in the clip by forming an offset in the pipe. An opening 67 is formed for receipt of the connector pin and fastener openings 68 are formed in the other end for the receipt of fasteners therethrough for attachment to the bridging member 69.

Thousands of composite trusses have been installed and the numbers are increasing each year. Nearly all of the trusses must be braced in a lateral direction and hence thousands of briding clips have been installed and continue to be required. The bridging clip of the present invention has been installed on several major installations at a significant cost savings over the prior art installations and with a greater factor of safety against truss overturn.

The bridging clips of the present invention may be used in bracing trusses as described in my application, Ser. No. 758,061, filed Jan. 10, 1977 entitled Truss Structure with Clevis Assembly Joints.

It is to be understood that where the bracing is used with the clevis truss, the form of the invention with the pins extending completely from edge to edge is used.

I claim:

1. A bridging clip for connecting composite trusses to a wood lateral brace and preventing rotation of the bottom chord wherein said trusses include a wood bottom chord, metal webs formed with a pin opening therethrough, and metal pins connected to said chords and extending through said web pin openings, said pins extend transversely to said chords and extend beyond both edges of said chords, said wood lateral brace is located parallel to said pins, within the intersecting metal webs and extend at right angles to said trusses; said clip comprises:

a. first and second identical elongated metal members each formed with a pin opening therethrough at a first end adapted for receiving and connection to opposite ends of said metal pin therethrough for transmitting loads from said wood brace to said chords and metal webs of said truss and for resisting rotation of said bottom chord from moment forces imposed by said metal webs on said metal pin; and a surface adjacent said opening adapted for engaging opposite edges of said wood chord;

b. each of said elongated clip members includes a second end formed with a plurality of fastener openings adapted for receiving fasteners for connecting said clips to said wood bracing member, and each member has a surface adjacent said fastener openings adapted for engaging opposite sides of said wood brace;

c. seat means formed in each of said clips adapted for engaging the lower edge of said wood brace; and d. each of said elongated clip members extends from an end of said pin at substantially right angles thereto and said second ends of said clips are connected to said wood bracing member substantially vertically above the side edges of said chord.

2. A bridging clip as described in claim 1 comprising:

a. said clip is formed from a tubular member wherein said first end is formed with a flat surface adjacent said pin opening; and b. said second end is formed with a flat surface oriented substantially at right angles to said flat surface of said first end.

3. A bridging clip as described in claim 2 comprising:

a. said tubular member is formed with an offset portion forming said seat means.

4. A bridging clip as described in claim 1 comprising:

a. said elongated metal member is formed from a sheet metal strip;

b. said sheet metal member is formed with a single diagonal bend line and bent therealong providing two right angularly related surfaces to rigidify said sheet metal member; and c. said sheet metal member is formed with a slit and a transverse bend line and bent therealong providing said seat means and to rigidify said sheet metal member.

5. A bridging clip as described in claim 4 comprising:

a. said sheet metal member is formed with a slit parallel to said diagonal bend line which intersects said transverse bend line for forming said seat means.

* * * * *

UNITED STATES PATENT AND TRADEMARK OFFICE

CERTIFICATE OF CORRECTION

PATENT NO. : 4,106,257

DATED : August 15, 1978

INVENTOR(S) : Tyrell T. Gilb

It is certified that error appears in the above-identified patent and that said Letters Patent are hereby corrected as shown below:

In the title, change "BEARING" to --- BRIDGING ---

Column 1, line 16, change "overtune" to --- overturn ---

Column 1, line 41, change "compressions" to --- compression ---

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*